United States Patent [19]

Stenkvist

[11] 3,988,525

[45] Oct. 26, 1976

[54] DIRECT CURRENT ARC FURNACE WITH CHARGING MEANS

[75] Inventor: Sven-Einar Stenkvist, Vasteras, Sweden

[73] Assignee: Allmanna Svenska Elektriska Aktiebolaget, Vasteras, Sweden

[22] Filed: Apr. 30, 1975

[21] Appl. No.: 573,312

[30] Foreign Application Priority Data

May 21, 1974 Sweden ..... 7406714

[52] U.S. Cl. ..... 13/11; 13/33

[51] Int. Cl.[2] ..... H05B 7/18

[58] Field of Search ..... 13/9, 10, 11, 33

[56] References Cited

UNITED STATES PATENTS

| | | | |
|---|---|---|---|
| 3,462,538 | 8/1969 | Pellegrini et al. | 13/10 X |
| 3,472,649 | 10/1969 | Sibakin et al. | 13/33 UX |
| 3,789,127 | 1/1974 | Bowman | 13/10 X |

*Primary Examiner*—Harry Moose

*Attorney, Agent, or Firm*—Kenyon & Kenyon Reilly Carr & Chapin

[57] ABSTRACT

A DC arc furnace has a hearth formed with an extension in which a melt-contact electrode is positioned, and has an arcing electrode laterally spaced from this contact electrode. This results in the formation of an arc that is oblique in a direction facing away from the contact electrode. To prevent the arc from being excessively destructive with respect to the furnace vessel's side wall toward which the arc was directed, furnace charging material, in particulate form, is continuously fed to a melt in the furnace, as a flow directed into the arc foot spot formed by the oblique arc, resulting in a maximum efficiency of energy absorption of the normally cold charging material and at the same time, via the charged material, shading the lining of the furnace vessel from an attack by the arc.

3 Claims, 2 Drawing Figures

DIRECT CURRENT ARC FURNACE WITH CHARGING MEANS

The present invention relates to a DC arc furnace with a furnace vessel and at least one consumable electrode, and at least one contact electrode arranged in an extension to the furnace vessel.

A furnace of this type is described in Swedish patent application No. 7317535-8. The contact electrode in this furnace is normally placed so that direct heat radiaton from the consumable electrode towards the contact electrode is prevented.

In case of continuous melting in arc furnaces of, for example, prereduced material (pellets) or finely-divided scrap, the charge material is fed either through a hole in the furnace roof so that the material falls centrally between the three electrodes (in a three-phase furnace), or through three holes in the roof, so that the material falls down at three locations between the respective electrode and the furnace wall. Continuous charging is a new branch of development and there are a number of plants of this kind in operation. For reasons of expense and for technical reasons in view of the material handling plant, the alternative involving central charging has been the predominant choice.

However, operating experience shows that, using the arrangement with central charging, the wear on the lining in the furnace will be a difficult problem to cope with. This is due to the fact that the electromagnetic current forces drive the arcs outwards towards the furnace wall, which is not protected by the charge material.

The alternative with charging at three locations between the respective electrode and the furnace wall should reasonably give a better result in this respect, but — as mentioned — at the expense of a more complicated and expensive material handling plant. This obviously applies to AC furnaces.

In a DC arc furnace which is supplied with current through a contact electrode at the periphery of the furnace, such as defined in the above-mentioned application, the arc will be strongly affected by the electromagnetic current forces, so that it becomes oblique in a direction facing away from the contact electrode. This has hitherto been regarded as a drawback, which has sometimes given cause to certain proposals for reconstructions of the furnace.

In the present invention this conditon which was previously regarded as a disadvantage is utilized. The furnace according to the invention is characterised in that, in the furnace roof and/or the furnace wall, there are arranged charging means for fragmented scrap or pellets or pulverulent materials, alloying additives and/or reaction agents for charging to the arc spot at the electrode at the far side of this relatively to the contact electrode. Thus, different kinds of alloying materials are used here, for example such as contain iron. By continuously charging such materials to the arc spot this fact of an oblique arc is made use of, and the charge is directed straight into the arc or to the foot point of the arc on the bath surface or immediately in front of this.

Figure 1:
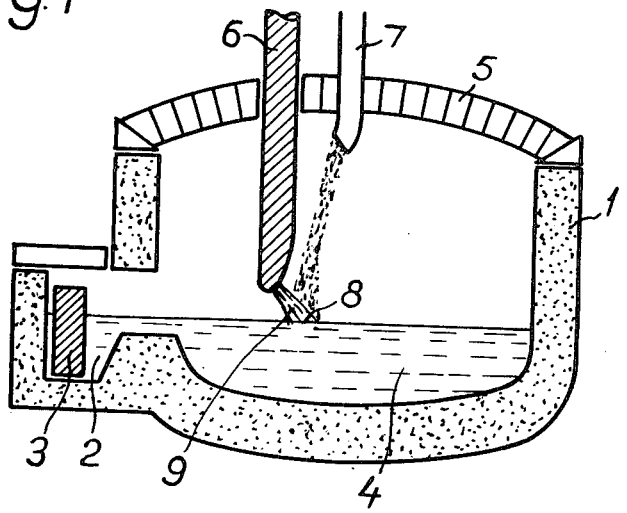
Figure 2:
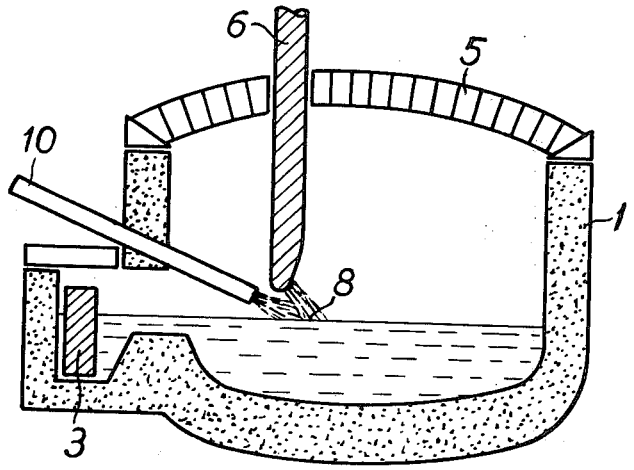

The arrangement appears from the accompanying two FIGS. 1 and 2, of which

FIG. 1 refers to charging through the furnace roof and

FIG. 2 a charging through a lance in the furnace wall which may be particularly suitable for injecting pulverous additives.

FIG. 1 shows a furnace with a furnace vessel 1 and an extension 2 for a contact electrode 3, containing a melt 4, for example an iron melt. Through the furnace roof 5 there is drawn one or several electrodes, which may be graphite electrodes or Soderbert electrodes and when it is a question of several electrodes these may be arranged in different ways known in the art. A charging tube 7 is arranged close to the electrode through the furnace roof and this tube 7 is intended for charging material and alloying additives, reaction or reducing agents, etc. It would be possible, for example, to charge refining agents or their oxidizing agents to the melt or aloying additives. The charging is so arranged that the powder will be supplied to the arc spot 8, i.e. where the arc 9 moves obliquely away from the contact electrode 3. Charging can also be performed in the vicinity of this arc spot or immediately above said spot. This will result in the most efficient energy absorption of the cold charging material, at the same time as this material will shade the lining from an attack by the arc. This manner of charging will probably also allow operation with longer arcs, i.e. higher voltage and lower current than what would otherwise be possible.

As opposed to a three-phase AC furnace, the above effect can be obtained in a DC furnace with only one supply opening in the roof, whether it is a question of a DC furnace with one arc electrode and one contact electrode as in the figure, or a DC furnace with several, for example three pairs of arc electrodes/contact electrodes, since in all cases the arc is directed obliquely in a direction facing away from the contact electrode towards the furnace centre. In the shown case according to FIGS. 1 and 2 only one electrode is used, but the condition will be similar when using several electrodes.

FIG. 2 shows an alternative embodiment with a contact electrode 3 and an electrode 6, where the charging is performed thrugh a lance 10 drawn through the furnace wall (and/or in the furnace roof 5). Also in this case the charging takes place to the arc spot 8. The lance is drawn from the side where the contact electrode 3 is applied and into the arc spot at the opposite side of the centre line of the electrode 6.

The invention can be varied in many ways within the scope of the following claims.

I claim:

1. A direct current arc furnace comprising a furnace vessel having a roof and a lower portion for containing a melt, said lower portion having an extension extending laterally from a peripheral portion of said lower portion and into which a portion of said melt can extend, a contact electrode positioned in said extension for immersion in said portion of the melt, at least one arcing electrode extending downwardly through said roof for forming an arc between the electrode and said melt at a position spaced inwardly from said extension and contact electrode, said arcing electrode forming an arc which becomes oblique in a direction facing away from said contact electrode when the electrodes are powered by direct current, said arc forming an arc foot spot on the surface of the melt in the furnace vessel's said lower portion, and means for continuously feeding a flow of furnace charging material into said arc foot spot.

2. The furnace of claim 1 in which said means is for feeding said flow directly into said arc so that the flow is directed into said foot spot.

3. The furnace of claim 1 in which said means is for feeding said flow to said arc foot spot at a position on the far side of the arc relative to said contact electrode.

* * * * *